US010918226B1

(12) United States Patent
Santarelli

(10) Patent No.: US 10,918,226 B1
(45) Date of Patent: Feb. 16, 2021

(54) DISPLAY TIER MERCHANDISE HOLDER

(71) Applicant: American Greetings Corporation, Cleveland, OH (US)

(72) Inventor: Anthony Santarelli, North Olmsted, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 16/542,730

(22) Filed: Aug. 16, 2019

(51) Int. Cl.
*A47F 5/00* (2006.01)
*A47F 7/28* (2006.01)
*A47F 7/14* (2006.01)

(52) U.S. Cl.
CPC ..... *A47F 5/0006* (2013.01); *A47F 7/148* (2013.01); *A47F 7/285* (2013.01)

(58) Field of Classification Search
CPC ..... A47F 5/0006; A47F 7/285; A47F 8/02; A47F 5/01; A47F 5/13; A47F 5/0031; A47F 7/148; A47F 3/147; A47B 73/002; A47B 55/02; A47B 87/001; A47B 87/02; A47G 25/24
USPC ..... D6/458, 462, 566
See application file for complete search history.

(56) References Cited

U.S. PATENT DOCUMENTS 226,857 A * 4/1880 Hoskins ..... A47F 7/145 211/55
553,571 A * 1/1896 Sproule ..... A47F 7/145 211/55
783,976 A * 2/1905 Pinten ..... A47F 7/145 206/741
1,031,595 A * 7/1912 Taber ..... A47F 5/0006 211/52
1,111,304 A * 9/1914 Forester ..... A47F 5/103 211/106.01
1,505,539 A * 8/1924 Burke ..... A47F 7/0071 248/127
1,820,275 A * 8/1931 Kelley ..... A47F 7/144 211/54.1
D91,717 S * 3/1934 Maguire ..... D6/678.4
2,236,330 A * 3/1941 Canficld ..... A47F 7/148 211/55
2,786,345 A * 3/1957 Scherer ..... F21V 35/00 431/295
3,167,313 A * 1/1965 Davenport ..... A63F 3/00697 273/262
3,343,776 A * 9/1967 Wieszeck ..... B42D 9/088 248/441.1
3,394,973 A * 7/1968 Scott ..... A47F 7/0021 312/262
3,712,521 A * 1/1973 Tanner ..... D05B 91/14 223/107
4,073,462 A * 2/1978 Whitaker ..... A01K 97/10 248/206.4

(Continued)

*Primary Examiner* — Ko H Chan
(74) *Attorney, Agent, or Firm* — Christine Flanagan

(57) ABSTRACT

A display tier merchandise holder is intended to be placed into an empty tier of a tiered merchandise display. It includes a base portion, stem, hook element and cross bar. It is capable of displaying product, such as gift bags, tags, tissue paper or other such merchandise, suspended therefrom. The display tier merchandise holder better distributes the weight of the merchandise thereby eliminating damage to the display tier, holder and merchandise. It also provides an improved aesthetic for the displayed merchandise.

14 Claims, 3 Drawing Sheets

(56) References Cited

U.S. PATENT DOCUMENTS

| | | | | | |
|---|---|---|---|---|---|
| D275,245 | S | * | 8/1984 | Pack | D6/675.5 |
| 5,180,128 | A | * | 1/1993 | Massey | A47F 5/0823 248/220.41 |
| D348,079 | S | * | 6/1994 | Bogen | D19/100 |
| 5,419,263 | A | * | 5/1995 | Mills | F16M 11/14 108/150 |
| D416,070 | S | * | 11/1999 | Malmberg | D22/136 |
| 6,336,564 | B1 | * | 1/2002 | Garnier | A47F 5/0068 211/162 |
| 6,427,853 | B2 | * | 8/2002 | Brozak, Jr. | A47F 1/12 211/128.1 |
| 7,665,617 | B2 | * | 2/2010 | Shea | A47F 5/0838 211/128.1 |
| D631,633 | S | * | 1/2011 | Navarre, II | D34/28 |
| 8,955,694 | B2 | * | 2/2015 | Belk | A47F 7/146 211/55 |
| 9,320,369 | B2 | | 4/2016 | Zobel et al. | |
| 9,380,867 | B2 | * | 7/2016 | Plikat | A47B 96/027 |
| D764,238 | S | * | 8/2016 | Guindi | D7/637 |
| D766,046 | S | * | 9/2016 | Guindi | D7/601 |
| 9,474,366 | B2 | * | 10/2016 | Plikat | A47B 5/06 |
| RE47,317 | E | * | 3/2019 | Sill | B65B 5/045 |
| 2003/0057336 | A1 | * | 3/2003 | Hochman | A47F 5/0823 248/220.21 |
| 2007/0114348 | A1 | * | 5/2007 | Nawrocki | A47F 5/0006 248/220.21 |
| 2009/0308821 | A1 | * | 12/2009 | Brand | A47F 7/143 211/45 |
| 2010/0155553 | A1 | | 6/2010 | Langley | |
| 2016/0095324 | A1 | * | 4/2016 | Jones | A21C 15/00 211/13.1 |

* cited by examiner

DISPLAY TIER MERCHANDISE HOLDER

RELATED APPLICATIONS

There are no applications related to this application.

FIELD OF THE INVENTION

The present invention is in the field of retail merchandizing. More specifically, the present invention is directed to an in-tier holder displaying gift bags or other hangable merchandise.

SUMMARY OF THE INVENTION

In one embodiment, the display tier merchandise holder of the present disclosure and related inventions includes a single wire-formed element having a base connected to a stem, the stem connected to a hook element, and a cross bar attached to the stem. The display tier merchandise holder is operative to be inserted into a tier of a tiered display, where the base is flush with the display tier floor and the stem is substantially flush with the front of the display tier and the hook extends outward in an upward sloping position.

In another embodiment, the display tier merchandise holder includes a base, a stem extending upward from the base, and a hook extending outward from the stem. The display tier merchandise holder is operable to be placed into a display tier to display merchandise suspended therefrom.

In still another embodiment, the display tier merchandise holder includes a substantially rectangular base structure, a stem which extends upward from the base structure, and a hook element which extends outward from the stem. The base structure, stem and hook element are formed out of a single wire. The display tier merchandise holder is operative to fit into a tier of a tiered merchandise display and the hook element is operative to display a plurality of product suspended therefrom.

DETAILED DESCRIPTION OF PREFERRED AND ALTERNATE EMBODIMENTS

Figure 1:
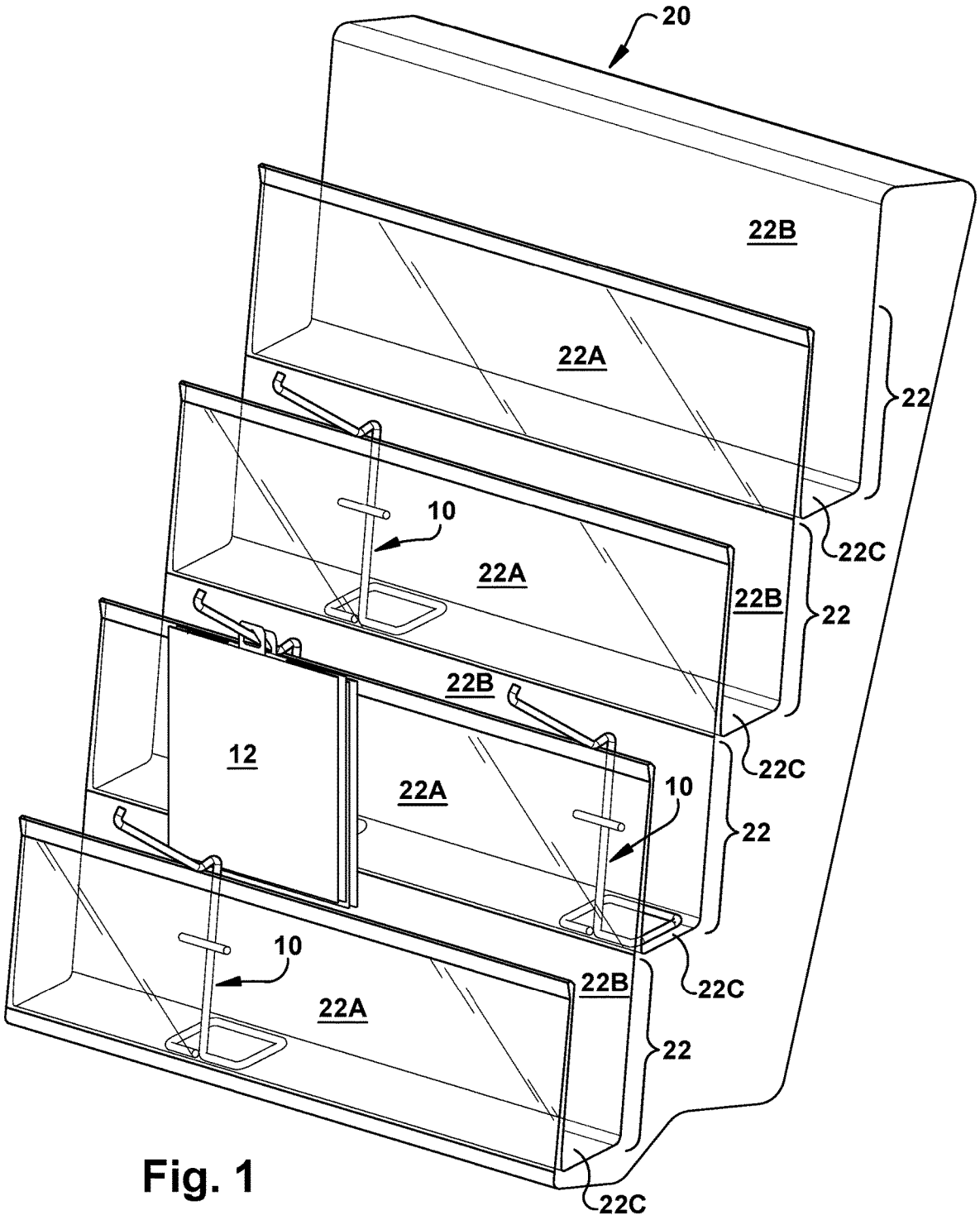
FIG. 1 is a perspective view of a portion of a tiered display with inserted display tier merchandise holders.
Figure 2:
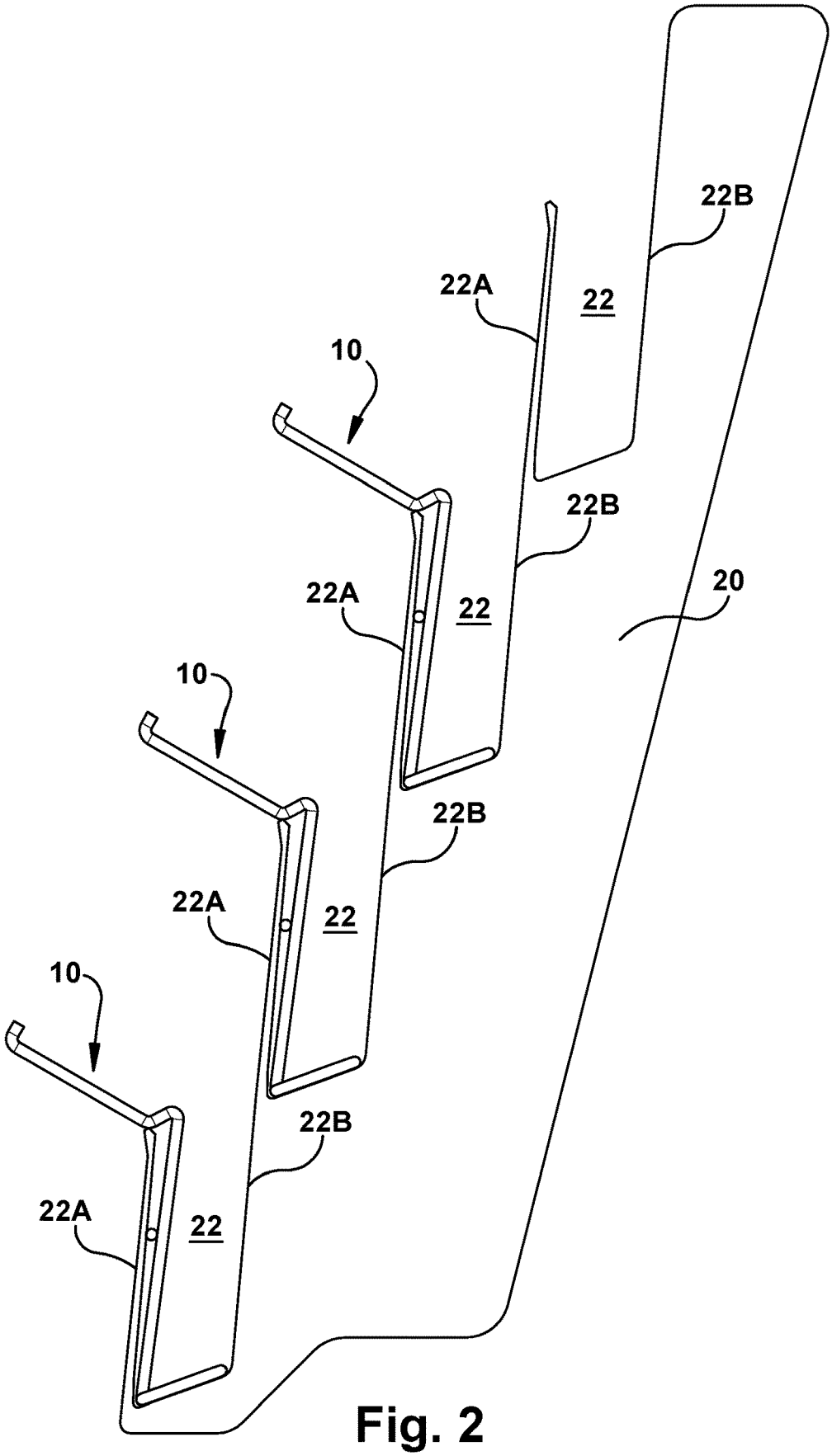
FIG. 2 is a profile view of a portion of a tiered display with inserted display tier merchandise holders.
Figure 3:
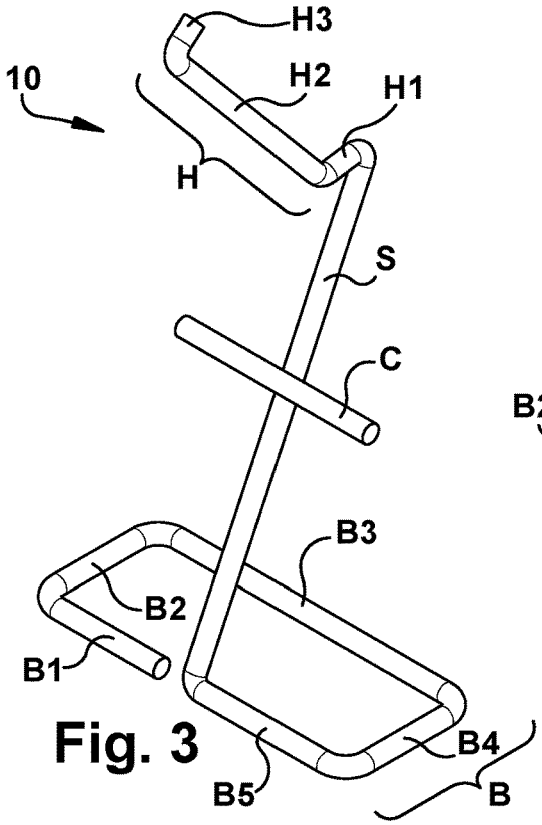
FIG. 3 is a perspective view of a display tier merchandise holder of the present invention.
Figure 4:
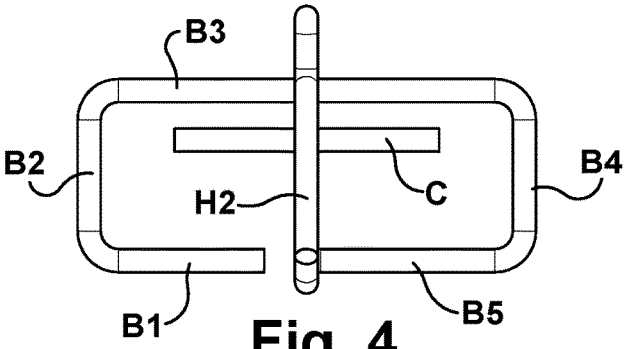
FIG. 4 is a top down view of the display tier merchandise holder of FIG. 3.
Figure 5:
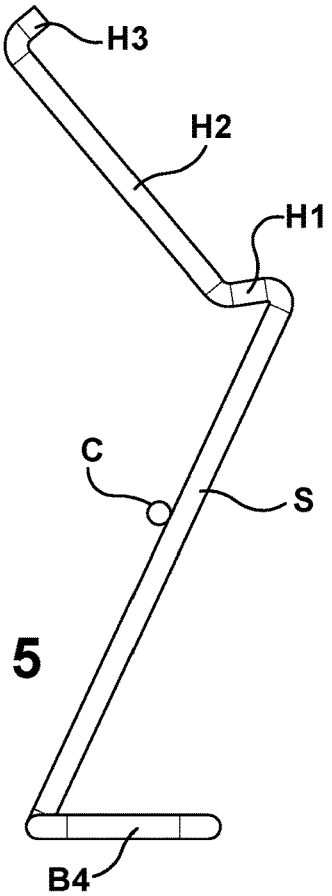
FIG. 5 is a right side view of the display tier merchandise holder of FIG. 3.
Figure 6:
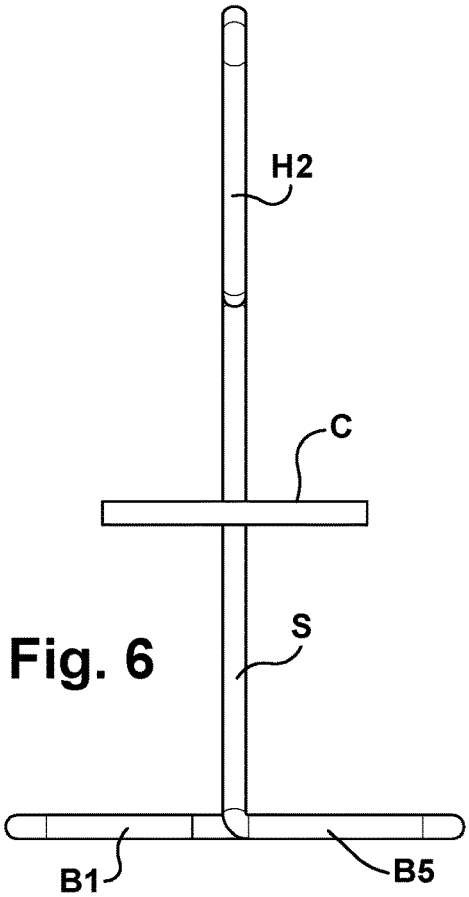
FIG. 6 is a front view of the display tier merchandise holder of FIG. 3.

The display tier merchandise holder 10 of the present disclosure and related inventions is a wire-formed hook with base B, stem S, cross bar C, and backward sloping hook element H. The display tier merchandise holder 10 allows gift bags or other such merchandise 12 to be displayed on a display tier 22 without causing any damage to the display tier 22 or merchandise 12.

The current method for displaying gift bags or other such merchandise (tissue paper, tags, etc. also referred to herein as "peggable product" 12) from a display tier 22 includes an injection molded hook that clips onto the injection molded clear display sham. Over time, when the hooks are loaded with peggable product 12, the weight of the product pulls downward on the hook and can damage or cause the hook (and product suspended therefrom) to detach from the display tier.

The display tier merchandise holder 10 of the present disclosure and related inventions improves upon this method by evenly distributing the product 12 weight evenly over the length of the display tier 22 and back wall of the display tier 22B. This minimizes damage to the hook 10, tier 22 and product 12 and presents an improved merchandise aesthetic. The display tier merchandise holder 10 also does not need to be mechanically (or otherwise) attached to the display tier 22. It can simply be placed into the display tier. This provides ease of use, set-up and removal. It also allows for additional merchandise 12 that does not otherwise fit into a tiered display to be displayed on a tier of said tiered display. The additional merchandise 12 may or may not be complimentary with the merchandise contained on the display. The display tier merchandise holder 10 also provides flexibility in enabling seasonal merchandise, which does not have yearly display space, to be displayed along with complimentary merchandise. For example, gift bags, tags and tissue paper displayed on a tiered greeting card display. While examples discuss and figures show gift bags hanging from a tiered greeting card display, other tiered merchandise displays and merchandise have been contemplated and are considered to be within the scope of this invention.

The display tier merchandise holder 10 is a wire formed element with a base B, a stem S, a cross bar C and a backward sloping hook portion H. The base B, stem S and backward sloping hook portion H are made from a single wire. The cross bar C is a separate element which is permanently attached to the stem S.

The base B of the display tier merchandise holder 10 is formed in a substantially rectangular shape and positioned horizontally. It is intended to be positioned within a tier 22 of a tiered merchandise display, flush with the floor 22C of said tier 22. In one embodiment, the base B is 3.25 inches wide and 1.125 inches long. The wire starts in a first portion B1 and turns into a second portion B2 which is perpendicular to the first portion B1. The second portion B2 turns into a third portion B3, which is perpendicular to the second portion B2 and parallel to the first B1. The third portion B3 extends the length of the base B and turns into a fourth portion B4 which is perpendicular to the third portion B3 and parallel to the second portion B2. The fourth portion B4 turns into a fifth portion B5 which is perpendicular to the fourth portion B4 and parallel to the third portion B3. The fifth portion B5 is collinear with the first portion B1 of the base B and extends upward to form the stem S of the display tier merchandise holder 10.

The stem S of the display tier merchandise holder 10 extends upward from the base B in a backward sloping manner. In one embodiment, the stem S is approximately 3.75 inches long and forms an approximate 65-degree angle with respect to the base B. The stem S is intended to sit within the display tier 22, flush with a front 22A of the display tier 22.

The stem S transitions into a hook element H. The hook element H contains a small transition segment H1 which extends forward from the stem S in a slightly angled manner. The transition segment H1 turns upward into the main hook element 112. The main hook element 112 is backward sloping with respect to the transition segment H1 and stem S. At the distal end of the main hook element H2 is a slightly upturned end segment H3. In one embodiment, the hook element H (including the transition H1, main hook element 112 and end segment 113) is approximately 2.688 inches long and forms and approximate 115-degree angle with respect to the stem S.

A cross bar C is attached (welded or otherwise) to the stem S. In one embodiment, the cross bar C is placed at approximately 2.5 inches from the bottom of the stem S (or from the base B). The cross bar C is intended to provide support and stability to the display tier merchandise holder 10.

In use, the display tier merchandise holder 10 is inserted into one row or tier 22 of a tiered merchandise display 20. As mentioned above, the base B of the display tier merchandise holder 10 is placed flush with the bottom 22C of the display tier 22 and the stem S sits flush with the front sham 22A of the display tier 22. The hook portion H then extends outward at a backward angle from the front sham 22A of the display tier 22. Gift bags or other peggable product 22 can be inserted onto the hook portion H and suspended therefrom. The backward slope of the hook portion H keeps the merchandise 12 from becoming inadvertently detached from the hook H and it shifts the weight off of the front sham 22A of the display tier 22 and down to the back wall 22B of the display tier 22. The display tier merchandise holder 10 does not warp or sag and will not pull out of the display tier 22. The display tier merchandise holder 10 also keeps the merchandise 12 at a better position for shopping and servicing.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A display tier merchandise holder comprising:
- a single wire-formed element having a base connected to a stem, the stem connected to a hook element;
- a cross bar attached and perpendicular to the stem;
- wherein the stem creates an acute angle with respect to the base and the hook creates an obtuse angle with respect to the stem;
- wherein the display tier merchandise holder is operative to be inserted into a card tier with the stem located adjacent to a front sham of the card tier and the cross bar in direct contact with the front sham of the card tier.

2. The display tier merchandise holder of claim 1, wherein the hook element is operative to suspend a plurality of peggable product therefrom.

3. The display tier merchandise holder of claim 2, wherein the plurality of peggable product are gift bags.

4. The display tier merchandise holder of claim 1, wherein the base is a substantially rectangular element.

5. A display tier merchandise holder comprising:
- a rectangular-shaped base;
- a stem extending upward from the base, in a backward sloping manner;
- a hook extending outward from the stem, in a backward sloping manner;
- a cross bar attached to the stem in a perpendicular manner;
- wherein the display tier merchandise holder is operable to be placed into a tier of a display to display merchandise suspended therefrom with the base sitting flush with a floor of tier, the stem positioned alongside a front sham of the tier and running the length of the front sham, the cross bar in contact with the front sham of the tier and the hook being positioned outside of the tier.

6. The display tier merchandise holder of claim 5, wherein the base, stem and hook are all formed from a single wire.

7. The display tier merchandise holder of claim 5, wherein when the display tier merchandise holder is inserted into a tier of a display, the stem is operative to sit flush with a front wall of the tier.

8. The display tier merchandise holder of claim 5, wherein when the display tier merchandise holder is inserted into a tier of a display, the display tier merchandise holder does not mechanically attach to the tier.

9. A display tier merchandise holder comprising:
- a substantially rectangular base structure;
- a stem which extends upward from the base structure in a backward sloping manner;
- a hook element which extends outward and upward from the stem in a backward sloping manner;
- wherein the base structure, stem and hook element are formed out of a single wire;
- wherein the display tier merchandise holder is operative to fit into a tier of a tiered display, with the rectangular base structure sitting atop a floor of the tier, and the stem sitting adjacent to the entire height of a front wall of the tier; and
- wherein the hook element is operative to display a plurality of product suspended therefrom.

10. The display tier merchandise holder of claim 9, wherein the stem forms an acute angle with respect to the base structure.

11. The display tier merchandise holder of claim 9, wherein the hook element forms an obtuse angle with respect to the stem.

12. The display tier merchandise holder of claim 9 further comprising a cross bar attached to the stem.

13. The display tier merchandise holder of claim 9 where the plurality of product are gift bags.

14. The display tier merchandise holder of claim 9, wherein when the display tier merchandise holder is inserted into a card tier, the base structure sits flush with a floor of the card tier and the stem sits flush with a front wall of the card tier.

* * * * *